US008128046B1

(12) United States Patent
Howard, Jr.

(10) Patent No.: US 8,128,046 B1
(45) Date of Patent: Mar. 6, 2012

(54) COMBINED MOBILE ELECTRONIC DEVICE HOLDER AND FASTENER MECHANISM

(76) Inventor: Charles E. Howard, Jr., Lamar, SC (US)

( * ) Notice: Subject to any disclaimer, the term of this patent is extended or adjusted under 35 U.S.C. 154(b) by 74 days.

(21) Appl. No.: 12/590,556

(22) Filed: Nov. 10, 2009

(51) Int. Cl.
*A47K 1/08* (2006.01)

(52) U.S. Cl. ..... 248/313; 224/930; 248/316.5

(58) Field of Classification Search ..... 224/269, 224/930, 929, 669, 670; 220/480, 476; 248/313, 248/316.7, 229.13, 229.23, 316.5; 379/455
See application file for complete search history.

(56) References Cited

U.S. PATENT DOCUMENTS 3,665,490 A 5/1972 Oskar
(Continued)

*Primary Examiner* — Ramon Ramirez
(74) *Attorney, Agent, or Firm* — P. Jeff Martin; The Law Firm of P. Jeffrey Martin, LLC

(57) ABSTRACT

A mobile electronic device holder adapted for removable attachment to a connector device is disclosed.

17 Claims, 2 Drawing Sheets

U.S. PATENT DOCUMENTS

| | | | | |
|---|---|---|---|---|
| 4,858,798 | A * | 8/1989 | Siddoway et al. | 224/242 |
| D316,999 | S | 5/1991 | Sarff | |
| 5,460,347 | A | 10/1995 | Schacher | |
| 5,529,271 | A | 6/1996 | Dunchock | |
| 5,711,469 | A | 1/1998 | Gormley et al. | |
| 5,941,487 | A | 8/1999 | Keely | |
| 6,443,343 | B2 * | 9/2002 | Kamiya | 224/269 |
| 6,516,982 | B1 * | 2/2003 | Childers | 224/197 |
| 6,568,576 | B1 * | 5/2003 | Godshaw et al. | 224/647 |
| 7,040,590 | B2 | 5/2006 | Carnevali | |
| 2002/0100784 | A1 * | 8/2002 | Baird | 224/679 |
| 2002/0113185 | A1 | 8/2002 | Ziegler | |
| 2003/0047575 | A1 * | 3/2003 | Enkerlin et al. | 224/271 |
| 2004/0089778 | A1 * | 5/2004 | Valentine et al. | 248/229.13 |
| 2004/0094592 | A1 | 5/2004 | Brown | |
| 2005/0284904 | A1 | 12/2005 | Knapp et al. | |
| 2006/0022822 | A1 * | 2/2006 | Wong et al. | 340/568.1 |
| 2006/0113340 | A1 | 6/2006 | Goradesky | |
| 2006/0226315 | A1 * | 10/2006 | Beasley et al. | 248/229.13 |
| 2007/0045496 | A1 * | 3/2007 | Kane | 248/313 |
| 2007/0175313 | A1 | 8/2007 | Vandervliet | |
| 2007/0262112 | A1 * | 11/2007 | Butler et al. | 224/669 |

* cited by examiner

COMBINED MOBILE ELECTRONIC DEVICE HOLDER AND FASTENER MECHANISM

RELATED APPLICATIONS

There are no previously filed, nor currently any co-pending applications, anywhere in the world.

BACKGROUND OF THE INVENTION

1. Field of the Invention

This application discloses and claims embodiments generally related to supports and holders for portable electronic devices, and more particularly, to a mobile electronic device holder adapted for removable attachment to a connector device.

2. Description of the Related Art

The prior art discloses various holding and carrying devices and apparatuses which provide a securement means for holding, supporting, or carrying portable or hand-held mobile electronic devices, such as cellular phones, personal digital assistant (PDA) organizers, pagers, Global Positioning Systems (GPS) devices, and other mobile electronic devices.

However, the aforementioned holding and carrying devices and apparatuses include mounting platforms being permanently or semi-permanently installed and are limited to specific applications, such as to a bicycle handle bar, or to a vehicle dash or console.

Thus, there is a long felt need for a mobile electronic device holder being removably attachable to a connector device which thereby allows the mobile electronic device to be removably secured to such connector device or virtually any device or surface to which or where user desires that such mobile electronic device be secured.

A search of the prior art did not disclose any patents that read directly on the claims of the instant invention; however, the following references were considered related.

U.S. Patent Application no. 2002/0113185 A1, published in the name of Ziegler;

U.S. Pat. No. 7,040,590 B2, issued in the name of Carnevali;

U.S. Patent Application no. 2007/0175313 A1, published in the name of Vandervliet;

U.S. Pat. No. 3,665,490, issued in the name of Oskar;

U.S. Pat. No. 5,529,271, issued in the name of Dunchock;

U.S. Pat. No. 5,711,469, issued in the name of Gormley et al.;

U.S. Pat. No. D316,999, issued in the name of Sarff;

U.S. Pat. No. 5,460,347, issued in the name of Schacher;

U.S. Patent Application no. 2005/0284904 A1, published in the name of Knapp et al.;

U.S. Patent Application no. 2006/0113340 A1, published in the name of Goradesky;

U.S. Pat. No. 5,941,487, issued in the name of Keely; and

U.S. Patent Application no. 2004/0094592 A1, published in the name of Brown.

Accordingly, a need has arisen for a mobile electronic device holder adapted for removable attachment to a connector device of user's choice in a quick, easy, and efficient manner. The development of the mobile electronic device holder fulfills this need.

This application presents claims and embodiments that fulfill a need or needs not yet satisfied by the products, inventions and methods previously or presently available. In particular, the claims and embodiments disclosed herein describe a mobile electronic device holder which includes an attachment mechanism facilitating removable attachment by the mobile electronic device to a connector device, the mobile electronic device holder providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Therefore, it is an object of the present invention to provide a container having a volume suitably dimensioned for accepting a mobile electronic device and removably holding the electronic device securely therein.

It is another object of the present invention to provide a container for accommodating a mobile electronic device which includes an attachment mechanism for facilitating removable attachment by the container with inserted mobile electronic device to a connector device.

It is still another object of the present invention to provide a mobile electronic device holder being available in a variety of desired color choices, and which may also be provided with ornamentation or indicia.

In accordance with one embodiment of the present invention, a mobile electronic device holder is disclosed. The mobile electronic device holder comprises a rectangular container having a substantially continuous closed tubular walled body, the body comprising an open upper end opposing a closed lower end. The body further comprises a rear wall and a front wall, wherein the rear wall and the front wall are integrally joined substantially perpendicular by a pair of lateral side walls.

The open upper end of the body of the container provides ingress into an interior cavity formed within the closed tubular walled body. The cavity defines a volume suitably dimensioned for accepting a mobile electronic device and removably holding the electronic device securely therein.

The front wall of the body includes a relief formed therein as an elongated, wide slot which extends downward intermediate from an upper edge of the front wall into the interior cavity of the body.

The mobile electronic device holder further comprises an attachment mechanism for facilitating removable attachment by the container, and hence, the mobile electronic device to a connector device or other apparatus. The attachment mechanism is a clamp or clip. The clamp includes a support plate to which the body is suitably mounted. After insertion of the mobile electronic device into the cavity of the body, the clamp is removably attached to a connector device, thereby allowing the mobile electronic device to be removably secured to such connector device or virtually any device or surface capable of being clamped by clamp to which or where user desires that such mobile electronic device be secured.

The mobile electronic device holder is envisioned to be manufactured in any number of desired color choices and may also be provided with ornamentation or indicia.

The use of the present invention allows an electronic mobile device to be removably attached to a connector device of user's choice in a quick, easy, and efficient manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
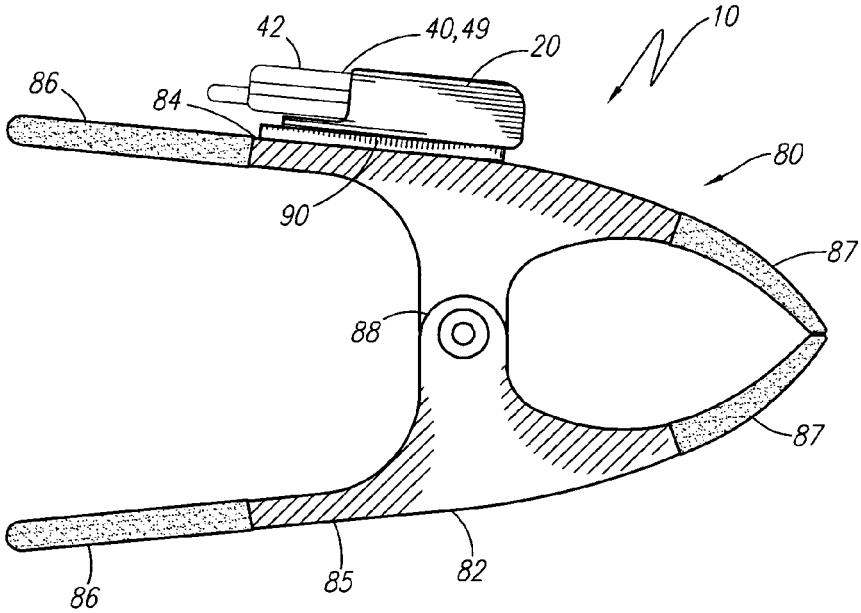
FIG. 1 is a side elevational view of a mobile electronic device holder, according to the preferred embodiment of the present invention.

With reference to FIGS. 1, and 3-7, a mobile electronic device holder 10 is disclosed, according to one embodiment of the present invention. The mobile electronic device holder 10, hereinafter holder 10, is an apparatus for holding a mobile electronic device 40 or other device, wherein the apparatus is adapted for removable attachment to a connector device 70, such as a golf bag 72. The holder 10 comprises a rectangular container 20 having a substantially continuous closed tubular walled body 22, the body 22 comprising an open upper end 23 opposing a closed lower end 24. The body 22 further comprises a rear wall 25 having a front surface 25*a* and a rear surface 25*b*, and a front wall 26, wherein rear wall 25 and front wall 26 are integrally joined substantially perpendicular by a pair of lateral side walls 27 and 28. The rear wall 25, front wall 26, and pair of lateral side walls 27, 28 each integrally extends vertically from the lower end 24.

The tubular walled body 22 is preferably manufactured from a lightweight, resilient material such as plastic or thermoplastic. The body 22 may be constructed utilizing a common molding process such as injection molding, blow molding, extrusion, or other molding and fabricating methods. Preferred plastic or thermoplastic materials include polypropylene, acrylonitrile-butadiene-styrene (ABS), polyethylene, polyurethane, polycarbonate, or blends thereof, and ABS/Nylon blend. Alternatively, the body 22 may be constructed of a lightweight, resilient material such as metal, metallic-plastic composite, or wood.

The open upper end 23 of the body 22 of the container 20 provides ingress into an interior cavity 30 formed within the closed tubular walled body 22. The cavity 30 defines a volume suitably dimensioned for accepting a mobile electronic device 40 and removably holding the device 40 securely therein in a snug-fit manner. It is therefore within the scope of the present invention that a length L, width W, and depth D of the cavity 30 may be increased or decreased independently or in different combinations so as to accommodate various mobile electronic devices 40. Further, the lateral side walls 27, 28 may each define an incurvate or concave shape which shapely conforms to the external contour of the mobile electronic device 40, thereby allowing the mobile electronic device 40 to be removably held in the cavity 30 of the container 20 in a snug-fit manner. Mobile electronic device 40 is intended to include but is not limited to a golf Global Positioning System (GPS) device 49, a cellular telephone 48, a personal digital assistant (PDA) organizer, a portable radio, a pager, or other hand-held mobile electronic devices.

Figure 8:
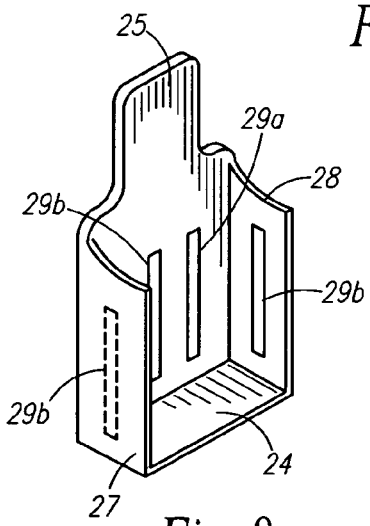
FIG. 8 is a front perspective view of the body of the container of the present invention shown with the front wall removed to illustrate the retainer element, according to one embodiment of the present invention.

Referring now to FIG. 8, in order to enhance a snug-fit by mobile electronic device 40 in cavity 30, and also to afford protection thereto, a retainer element 29*a* is provided. The retainer element 29*a* is defined as an elongated strip 29*b* constructed of a soft, flexible, shape-memory foam, plastic, or polymeric material. The retainer element 29*a* is suitably attached longitudinally to an inner surface of at least each of the pair of lateral sidewalls 27, 28, and rear wall 25 so as to provide cushioned support against which the outer contour of the mobile electronic device 40 contacts, thereby affording protection thereto and also enhancing immobilization of the device 40. The soft, flexible, shape-memory foam, plastic, or polymeric material flexibly accommodates the external contours of the mobile electronic device 40.

Referring now more specifically to FIGS. 1-7, the rear wall 25 includes an upper edge 25*a* forming a pair of shoulders 29 between which a neck portion 50 integrally extends vertically therefrom. Once a mobile electronic device 40 is inserted through the open upper end 23 of the body 22 and into the cavity 30 thereof, the shoulders 29 create a space S bilateral to the neck portion 50 allowing an upper portion of the mobile electronic device 40 to be free of contact with the rear wall 25, thereby facilitating quick, easy, and efficient grip and removal of mobile electronic device 40 by user from cavity 30.

The front wall 26 defines a height measuring less than a height defining the rear wall 25. The front wall 26 includes a relief 60 formed therein as an elongated, wide slot 62 which extends downward intermediate from an upper edge of the front wall 26 into the interior cavity 30 of the body 22. The slot 62 allows for the screen 42 or display panel and at least a portion of the keypad 44 of the electronic mobile device 40 to be easily viewed and accessed by the user while the device 40 resides within the body 22 of container 20. The slot 62 may be covered with a transparent plate 64.

Referring now more particularly to FIGS. 1-3, and 7, the mobile electronic device holder 10 further comprises an attachment mechanism 80 for facilitating removable attachment by the container 20, and hence, mobile electronic device 40 to a connector device 70 or other apparatus. The attachment mechanism 80 is a clamp 82 or clip comprising a first elongated arm 84 and a second elongated arm 85 being pivotally connected so as to allow the first elongated arm 84 and the second elongated arm 85 to pivotally move between open and closed positions. Each arm 84, 85 comprises a lower end 86 opposing an upper gripping end 87. The clamp 82 includes a spring 88 which biases the upper gripping end 87 of each arm 84, 85 to a closed, resting position, as illustrated in FIG. 1. The clamp 82 further includes a support plate 90 suitably mounted to an outer surface of either the first elongated arm 84 or the second elongated arm 85. The support plate 90 is shown herein as being mounted to the first elongated arm 84.

The body 22 is attached to the support plate 90 by suitably mounting the rear surface 25*b* of the rear wall 25 of body 22 to the support plate 90. After insertion of the mobile electronic device 40 into the cavity 30 of the body 22, the clamp 82 is removably attached to a connector device 70, thereby allowing the mobile electronic device 40 to be removably secured to such connector device 70 or virtually any device or surface capable of being clamped by clamp 82 to which or where user desires that such mobile electronic device 40 be secured. The connector device 70 may therefore include, but is not limited to a golf bag 72, a belt, a golf cart, a bicycle, a table, or a desk.

Figure 2:
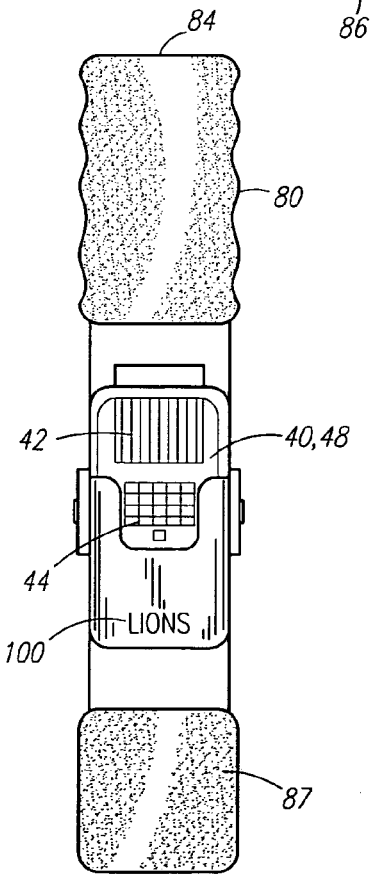
FIG. 2 is a front side elevational view of the mobile electronic device holder, according to one embodiment of the present invention.
Figure 3:
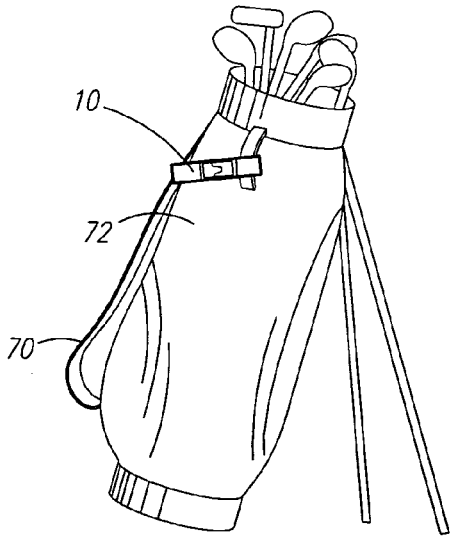
FIG. 3 is a perspective view of the mobile electronic device holder shown attached to a connector device, according to one embodiment of the present invention.
Figure 4:
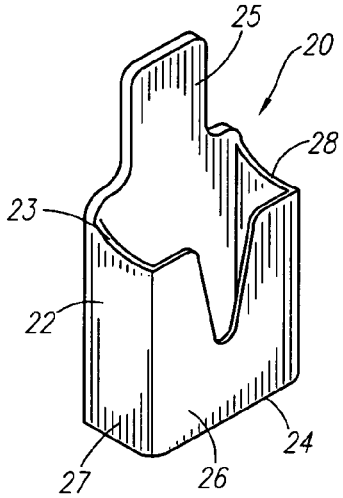
FIG. 4 is a front perspective view of the container of the present invention, according to one embodiment thereof.
Figure 6:
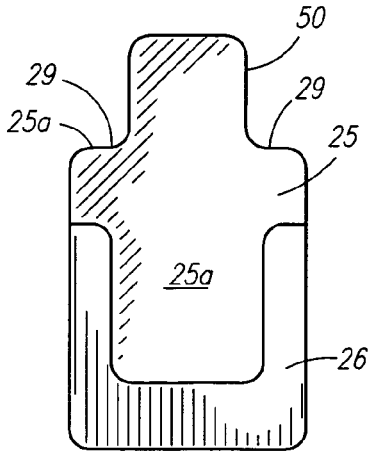
FIG. 6 is a front plan view of the container, according to one embodiment of the present invention.
Figure 7:
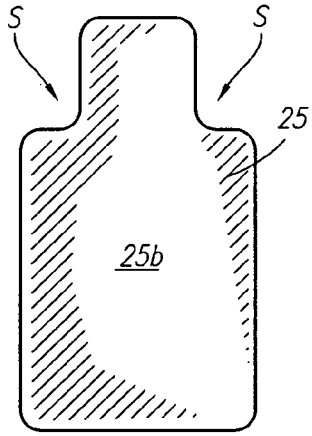
FIG. 7 is a bottom plan view of the container of FIG. 6.
Figure 5:
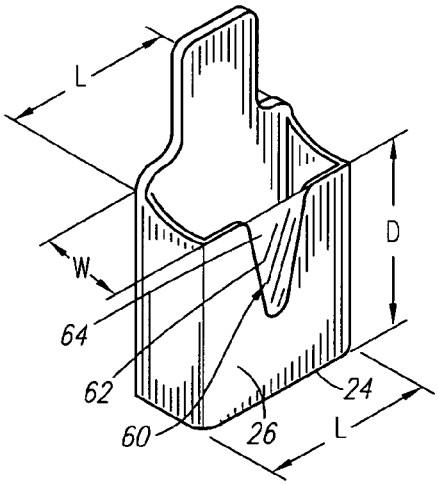
FIG. 5 is a front perspective view of the container of the present invention illustrating dimensional characteristics thereof, according to one embodiment of the present invention.

Finally, referring to FIG. 2, the mobile electronic device holder 10 is envisioned to be manufactured in any number of desired color choices. In addition, the mobile electronic device holder 10 may be provided with ornamentation or indicia 100 in the form of a company or corporate name or logo, wording, school logo, picture, photograph, or any other decorative, informational, promotional or advertisement indicia.

The use of the present invention allows an electronic mobile device to be removably attached to a connector device of user's choice in a quick, easy, and efficient manner.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A mobile electronic device holder, the holder comprising:

a container for holding a mobile electronic device, the container having a substantially continuous closed tubular walled body, the body comprising:

an open upper end opposing a closed lower end;

a rear wall having a front surface and a rear surface;

an interior cavity; wherein the rear wall includes an upper edge forming a pair of shoulders between which a neck portion integrally extends vertically therefrom, the shoulders creating a space bilateral to the neck portion allowing an upper portion of the mobile electronic device to be free of contact with the rear wall, thereby facilitating quick, easy, and efficient grip and removal of the mobile electronic device from the interior cavity, and wherein the open upper end of the body provides ingress into the interior cavity formed within the body, the interior cavity defines a volume suitably dimensioned for accepting a mobile electronic device and removably holding the mobile electronic device securely therein in a snug-fit manner; and an attachment mechanism.

2. The mobile electronic device holder of claim 1, wherein the front wall defines a height measuring less than a height defining the rear wall.

3. The mobile electronic device holder of claim 2, wherein the front wall includes a relief formed therein as an elongated, wide slot which extends downward intermediate from an upper edge of the front wall into the interior cavity of the body, wherein the slot allows for a screen and at least a portion of a keypad of the electronic mobile device to be easily viewed and accessed while the mobile electronic device resides within the body.

4. The mobile electronic device holder of claim 3, wherein the body is manufactured so as to be available in any number of colors.

5. The mobile electronic device holder of claim 3, wherein the body is provided with ornamentation and/or indicia.

6. The mobile electronic device holder of claim 1, wherein the attachment mechanism comprises a first elongated arm and a second elongated arm being pivotally connected so as to allow the first elongated arm and the second elongated arm to pivotally move between open and closed positions.

7. The mobile electronic device holder of claim 6, wherein each arm of the attachment mechanism comprises a lower end opposing an upper gripping end, the attachment mechanism includes a spring which biases the upper gripping end of each the arm to a closed, resting position.

8. The mobile electronic device holder of claim 7, wherein the attachment mechanism includes a support plate having a lower surface suitably mounted to an outer surface of either the first arm or the second arm.

9. The mobile electronic device holder of claim 8, wherein the support plate having an upper surface to which the rear surface of the rear wall of the body is mounted, whereupon insertion of the mobile electronic device into the interior cavity of the body, the attachment mechanism is removably attached to a connector device, thereby removably attaching the mobile electronic device to the connector device.

10. The mobile electronic device holder of claim 9, wherein the connector device is a golf bag.

11. The mobile electronic device holder of claim 1, wherein the body defines a rectangular configuration.

12. The mobile electronic device holder of claim 1, wherein the pair of lateral side walls each define an incurvate or concave shape which shapely conforms to an external contour of the mobile electronic device.

13. A mobile electronic device holder, the holder comprising:

a container for holding a mobile electronic device, the container having a substantially continuous closed tubular walled body, the body comprising:

an open upper end opposing a closed lower end;

a rear wall having a front surface and a rear surface;

a front wall;

a pair of lateral side walls, wherein the front wall and the rear wall are integrally joined substantially perpendicular by the pair of lateral side walls, the rear wall, the front wall, and the pair of lateral side walls each integrally extends vertically from the closed lower end;

an interior cavity;

an attachment mechanism;

a support plate suitably mounted to the attachment mechanism, wherein the rear surface of the rear wall of the body is suitably mounted to the support plate; and a retainer element, wherein the open upper end of the body provides ingress into the interior cavity formed within the body, the interior cavity defines a volume suitably dimensioned for accepting a mobile electronic device and removably holding the mobile electronic device securely therein in a snug-fit manner, the rear wall includes an upper edge forming a pair of shoulders between which a neck portion integrally extends vertically therefrom, the shoulders creating a space bilateral to the neck portion allowing an upper portion of the mobile electronic device to be free of contact with the rear wall, thereby facilitating quick, easy, and efficient grip and removal of the mobile electronic device from the interior cavity, the front wall defines a height measuring less than a height defining the rear wall, and wherein the front wall includes a relief formed therein as an elongated, wide slot which extends downward intermediate from an upper edge of the front wall into the interior cavity of the body.

14. The mobile electronic device holder of claim 13, wherein the attachment mechanism is a clamp.

15. The mobile electronic device holder of claim 13, wherein the retainer element is defined as an elongated strip suitably attached longitudinally to an inner surface of at least each of the pair of lateral sidewalls and the rear wall so as to provide cushioned support against which an outer contour of the mobile electronic device contacts, thereby affording protection thereto and also enhancing immobilization of the mobile electronic device.

16. The mobile electronic device holder of claim 15, wherein the retainer element is constructed of a soft, flexible, shape-memory foam, plastic, or polymeric material.

17. The mobile electronic device holder of claim 13, wherein the relief is covered with a transparent plate.

* * * * *